US005704375A

United States Patent [19]

Wood

[11] Patent Number: 5,704,375

[45] Date of Patent: Jan. 6, 1998

[54] ARTIFICIAL NAIL

[76] Inventor: Sue L. Wood, 1318 74th St. N., St. Petersburg, Fla. 33710

[21] Appl. No.: 716,515

[22] Filed: Sep. 18, 1996

[51] Int. Cl.[6] ..... A45D 31/00

[52] U.S. Cl. ..... 132/73

[58] Field of Search ..... 132/73, 73.5, 200, 132/285; D28/56, 62

[56] References Cited

U.S. PATENT DOCUMENTS

| | | | |
|---|---|---|---|
| 2,941,535 | 6/1960 | Lappe | 132/73 |
| 4,554,935 | 11/1985 | Hokama | 132/73 |
| 5,127,414 | 7/1992 | Mast et al. . | |
| 5,146,935 | 9/1992 | Rumore et al. . | |
| 5,413,123 | 5/1995 | Aylott . | |
| 5,450,864 | 9/1995 | La Joie et al. . | |

*Primary Examiner*—Todd E. Manahan
*Assistant Examiner*—E. Robert
*Attorney, Agent, or Firm*—Joseph N. Breaux

[57] ABSTRACT

An artificial nail includes a nail attachment portion having a contoured inner surface sized and shaped to conform to at least the forward edge of a user's existing fingernail. The artificial fingernail further has an accordion pleated portion having a plurality of pleats extending across the width of the artificial nail integrally formed with the nail attachment portion along the first side thereof. Furthermore, the artificial nail has a tip portion shaped and contoured to resemble a tip section of a human fingernail. The top portion is integrally formed with a second side of the accordion pleated portion. The artificial nail is preferably molded from acrylic, ABS or styrene plastic.

16 Claims, 2 Drawing Sheets

ARTIFICIAL NAIL

TECHNICAL FIELD

The present invention relates to artificial fingernail enhancement devices and more particularly to an artificial fingernail enhancement device having a flexible region including a plurality of pleats formed therein adapted for placement along the edge of the natural fingernail to provided stress relief from impacts to the artificial nail and to impart a more natural appearance of the artificial nail while in use.

BACKGROUND OF THE INVENTION

Artificial fingernail enhancements are commonly used by individuals desiring to have a more esthetically pleasing appearance. These enhancements are generally adhesively secured to the existing fingernail and extend past the nail bed of the finger out to the desired length. The nail enhancement is typically shaped like a natural fingernail and covered, if desired, with a nail polish. Although typical nail enhancements provide some degree of esthetic enhancement to the user, their use can result in damage to the natural fingernail of the user when the nail enhancement is impacted against a hard object. This damage occurs because the impact is transferred directly to the existing fingernail. The direct transfer of the impact to the existing fingernail can result in tearing of the existing fingernail and other painful trauma related injuries. It would be a benefit, therefore, to have an artificial nail that provided a mechanism for reducing the transfer of impact energy between the artificial nail and the user's existing fingernail when the artificial nail is impacted against a hard object.

Also, because typical artificial nails are adhesively secured over the existing fingernail, the artificial nail is raised above the normal level of the existing fingernail detracting from the esthetic effect of having an enhanced nail length. It would be a benefit, therefore, to have an artificial nail that could be formed over the edge of the existing fingernail during application of the artificial nail to lessen the esthetically detracting effect of having the artificial nail placed atop the existing fingernail.

SUMMARY OF THE INVENTION

It is thus an object of the invention to provide an artificial nail that includes a mechanism for reducing the impact energy transfer between the artificial nail and the user's existing fingernail when the artificial nail is impacted against a hard object.

It is a further object of the invention to provide an artificial nail that can be formed over the edge of the existing fingernail during application of the artificial nail to lessen the esthetically detracting effect of having the artificial nail placed atop the existing fingernail.

It is a still further object of the invention to provide an artificial nail that accomplishes both of the above objects in combination.

Accordingly, an artificial nail is provided. The artificial nail includes a nail attachment portion having a contoured inner surface sized and shaped to conform to at least the forward edge of a user's existing fingernail; an accordion pleated portion having a plurality of pleats extending across the width of the artificial nail integrally formed with the nail attachment portion along a first side thereof; and a tip portion, integrally formed with a second side of the accordion pleated portion, shaped and contoured to resemble a tip section of a human fingernail. The artificial nail is preferably molded from acrylic, ABS or styrene plastic.

Although the nail connecting portion can be adapted to conform to the entire existing nail, it is preferred to construct the artificial nail of the invention as a nail tip having a shortened nail connecting portion that covers only the edge portion of the existing fingernail.

In use, the nail connecting portion of the artificial nail is adhesively secured to the existing nail with a conventional artificial nail adhesive. Once the nail connecting portion is adhesively secured in place, the accordion pleated section is bent downward or otherwise formed by the user or nail technician over the existing fingernail edge and the top surface cavities of the accordion pleats filled with a nail filler of acrylic or other suitable nail filler. When a nail tip type artificial nail is used, the nail bed of the user is also filled with one of the previously discussed fillers and the nail shaped and polished in the conventional fashion.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
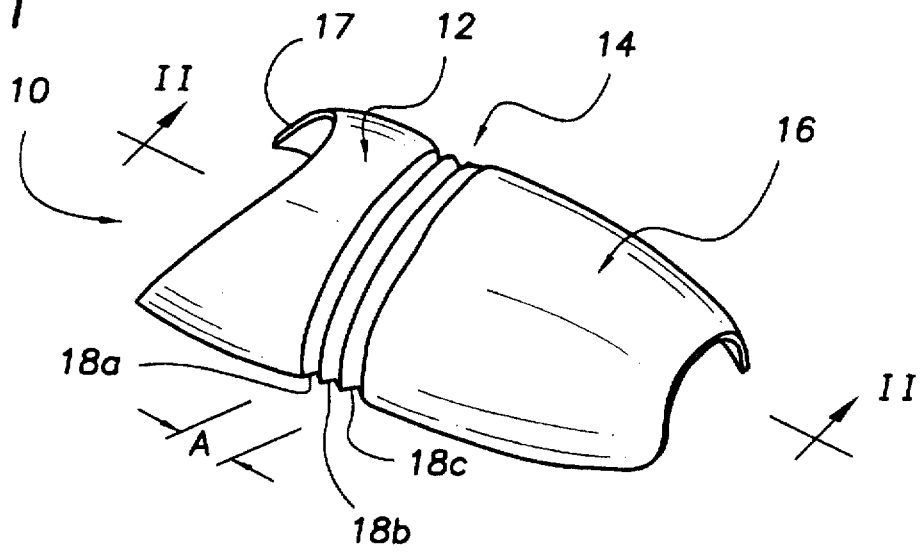
FIG. 1 is a perspective view of an exemplary artificial nail of the present invention showing the nail attachment portion, the accordion pleated portion, and the tip portion.

FIG. 1 shows an exemplary embodiment of the artificial nail of the present invention generally designated by the numeral 10. In this embodiment, artificial nail 10 is a nail tip nail enhancement molded from acrylic. Artificial nail 10 includes a nail attachment portion 12, an accordion pleated portion 14, and a tip portion 16.

Nail attachment portion 12 has a contoured inner surface sized and shaped to conform to at least the forward edge of a user's existing fingernail.

Accordion pleated portion 14 has three pleats 18*a–c* extending across the width of artificial nail 10 and integrally formed with the nail attachment portion along a first side thereof. Each pleat 18*a–c* has a depth of about one-thirty-seconds (1/32") of an inch and the entire accordion pleated portion is of a length "A" of about one-eighth (1/8") of an inch.

Tip portion 16 is integrally formed with a second side of accordion pleated portion 14 and shaped and contoured to resemble a tip section of a human fingernail.

Figure 2:
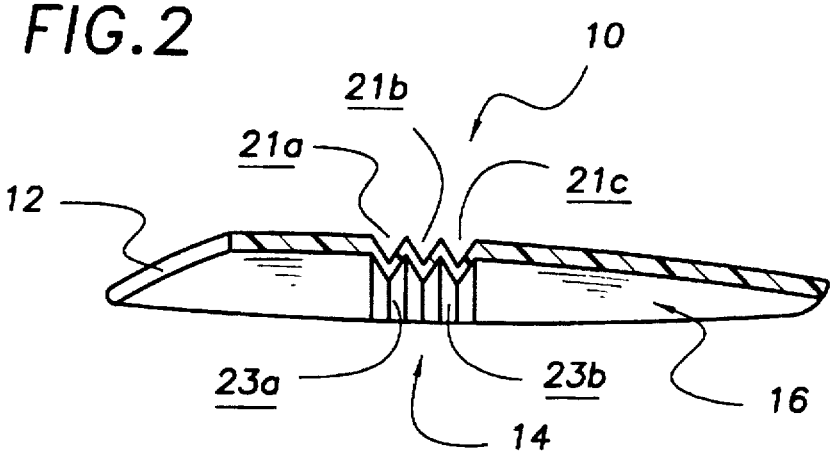
FIG. 2 is a crossectional view of the exemplary artificial nail of FIG. 1 along the line II—II showing the nail attachment portion, the accordion pleated portion and the tip portion.

FIG. 2 is a crossectional view of artificial nail 10 showing nail attachment portion 12, accordion pleated portion 14 and tip portion 16. In use, top surface cavities 21*a–c* are filled with an acrylic filler to form a smooth artificial nail top surface. Bottom surface cavities 23*a–b* are left unfilled to provided impact relief between the edge of artificial nail 10 and the wearer's existing fingernail.

Figure 3:
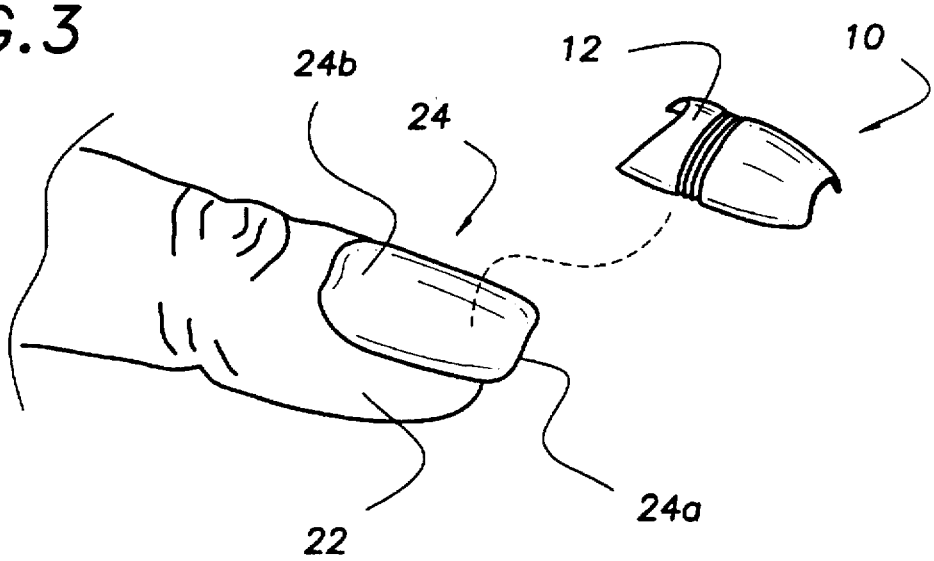
FIG. 3 is a perspective view showing a representative fingertip of a user including the existing fingernail and the artificial nail of FIG. 1 exploded away from the existing fingernail.
Figure 4:
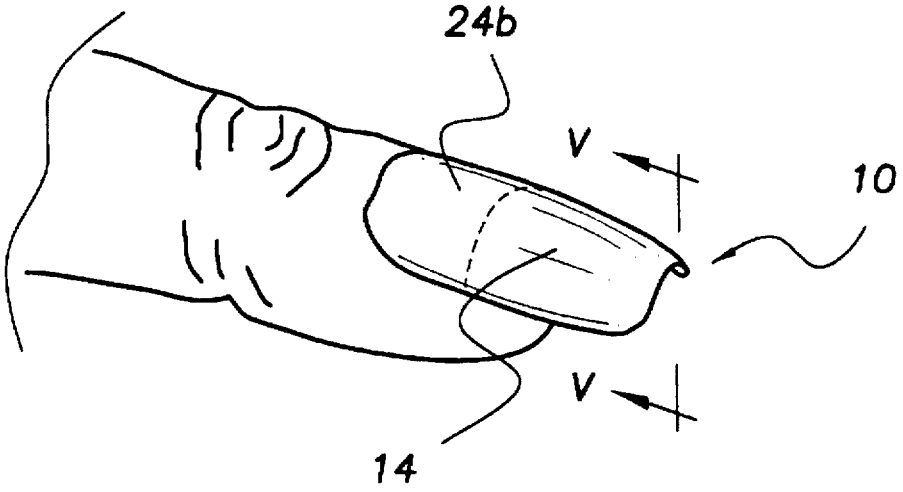
FIG. 4 is a perspective view showing the artificial nail of FIG. 1 adhesively secured in place with the accordion pleated portion formed and filled with a filler material and the nail bed section of the existing fingernail filled with a filler material.
Figure 5:
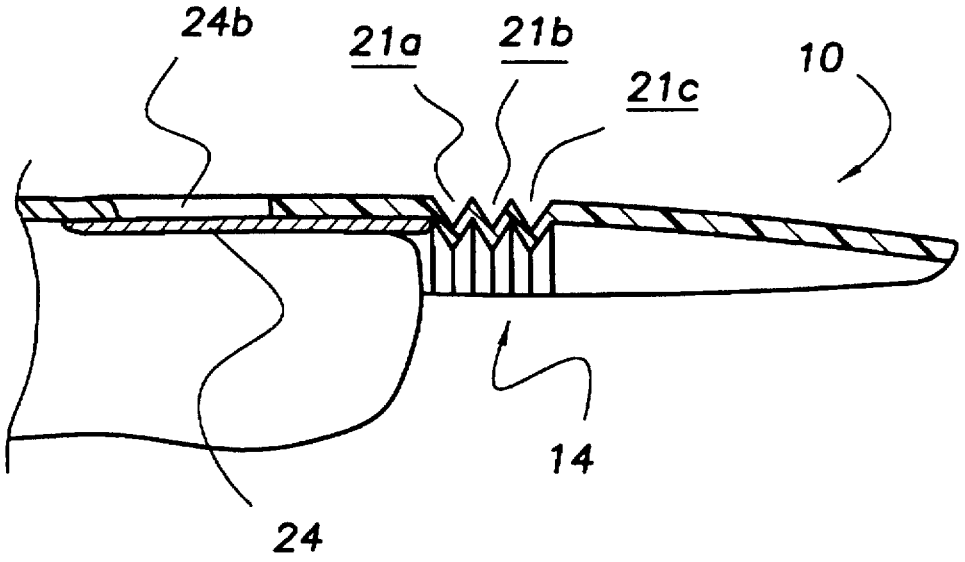
FIG. 5 is a is a crossectional view of FIG. 4 along the line V—V showing the artificial nail of FIG. 1 adhesively secured in place with the accordion pleated portion formed prior to filling with a filler material and the nail bed section of the existing fingernail prior to filling with a filler material.

FIG. 3 is a perspective view showing a representative fingertip 22 of a user including the existing fingernail 24, including the nail edge 24*a* and the nail bed 24*b*, and artificial nail 10 with a dashed directional line indicating placement of nail attachment portion 12 onto existing nail edge 24*a*. FIG. 4 is a perspective view showing artificial nail 10 adhesively secured in place, accordion pleated portion 14 formed and filled with a filler material, and nail bed section 24*b* of existing fingernail 24 filled with acrylic filler material. FIG. 5 is a crossectional view showing artificial nail 10 adhesively secured to existing fingernail 24 in place with accordion pleated portion 14 formed, and top surface cavities 21*a–c* and nail bed 24*b* prior to filling with an acrylic filler material.

It can be seen from the preceding description that an artificial nail has been provided that includes a mechanism for reducing the impact energy transfer between the artificial nail and the user's existing fingernail when the artificial nail is impacted against a hard object, and that is formable over the edge of the existing fingernail during application of the artificial nail to lessen the esthetically detracting effect of having the artificial nail placed atop the existing fingernail.

It is noted that the embodiment of the artificial nail described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An artificial nail comprising:

a nail attachment portion having a contoured inner surface sized and shaped to conform to at least a forward edge of a user's existing fingernail;

an accordion pleated portion having a plurality of pleats, extending across a width of said artificial nail, integrally formed with said nail attachment portion along a first side thereof; and a tip portion, integrally formed with a second side of said accordion pleated portion, shaped and contoured to resemble a tip section of a human fingernail.

2. The artificial nail of claim 1, wherein:

said artificial nail is molded from plastic.

3. The artificial nail of claim 2, wherein:

said accordion pleated portion defines at least two top surface cavities; and said top surface cavities are filled with a nail filler material.

4. The artificial nail of claim 3 wherein:

said accordion pleated section defines at least one bottom surface cavity.

5. The artificial nail of claim 3 wherein:

said accordion pleated section has a length of three-sixteenths of an inch.

6. The artificial nail of claim 5 wherein:

said accordion pleated section defines at least one bottom surface cavity.

7. The artificial nail of claim 2 wherein:

said accordion pleated section has a length of three-sixteenths of an inch.

8. The artificial nail of claim 7 wherein:

said accordion pleated section defines at least one bottom surface cavity.

9. The artificial nail of claim 2 wherein:

said accordion pleated section defines at least one bottom surface cavity.

10. The artificial nail of claim 1, wherein:

said accordion pleated portion defines at least two top surface cavities; and said top surface cavities are filled with a nail filler material.

11. The artificial nail of claim 10 wherein:

said accordion pleated section defines at least one bottom surface cavity.

12. The artificial nail of claim 10 wherein:

said accordion pleated section has a length of three-sixteenths of an inch.

13. The artificial nail of claim 12 wherein:

said accordion pleated section defines at least one bottom surface cavity.

14. The artificial nail of claim 1 wherein:

said accordion pleated section has a length of three-sixteenths of an inch.

15. The artificial nail of claim 14 wherein:

said accordion pleated section defines at least one bottom surface cavity.

16. The artificial nail of claim 1 wherein:

said accordion pleated section defines at least one bottom surface cavity.

* * * * *